US006572497B1

(12) United States Patent
Halsworth

(10) Patent No.: US 6,572,497 B1
(45) Date of Patent: Jun. 3, 2003

(54) POWER SWING TRAINING BAT

(76) Inventor: Robert M. Halsworth, 23207 Stelling Ave., Port Charlotte, FL (US) 33980

( * ) Notice: Subject to any disclaimer, the term of this patent is extended or adjusted under 35 U.S.C. 154(b) by 0 days.

(21) Appl. No.: 10/087,284

(22) Filed: Mar. 1, 2002

(51) Int. Cl.[7] ..... A63B 69/00
(52) U.S. Cl. ..... 473/453; 482/121; 473/422
(58) Field of Search ..... 473/453, 417, 473/451, 461, 422, FOR 103, 457, 423, 473; 482/121, 122

(56) References Cited

U.S. PATENT DOCUMENTS 2,134,451 A * 10/1938 Mogren ..... 482/94
3,083,016 A * 3/1963 Sumegi ..... 473/229
3,618,942 A * 11/1971 Bates et al. ..... 482/129
4,098,503 A * 7/1978 Antone ..... 473/457
4,600,190 A * 7/1986 Berokoff ..... 482/129
5,082,262 A * 1/1992 Sanchez ..... 473/458
5,269,512 A * 12/1993 Crowson et al. ..... 473/457
6,245,002 B1 * 6/2001 Beliakov ..... 482/148

* cited by examiner

*Primary Examiner*—Paul T. Sewell
*Assistant Examiner*—M. Chambers
(74) *Attorney, Agent, or Firm*—Frank A. Lukasik

(57) ABSTRACT

The power swing training bat of the invention is a tethered, truncated, training bat attached by flexible elastic to a fixed anchor point, or to a pulley and weight system. A swivel attachment is attached to the distal end of the bat and a flexible yoke is attached to the swivel attachment, and an elastic cord is attached to the yoke at one end and to a fixed point at the other. In a second embodiment, a cord is hung on a pulley attached to an anchor and a weight is placed at the other end.

2 Claims, 4 Drawing Sheets

POWER SWING TRAINING BAT

BACKGROUND OF THE INVENTION

The present invention relates to baseball training devices and more particularly to a tethered training bat attached by flexible elastic to a fixed anchor point, or to a pulley and weight system.

DESCRIPTION OF THE PRIOR ART

Prior art training bat devices are designed to accomplish one of the two basic purposes, to train a batter's muscles to swing the bat correctly, to develop the batter's muscles and improve batting strength and velocity. General batting practice using a pitcher or a pitching machine is sometimes inefficient particularly with newer players who may be unable to hit the ball. In this case, the batter gets little accuracy or muscle strength training. A pitching machine is a good device, however, it doesn't add any resistance to the swing and does not strengthen the muscles to give a more powerful swing.

The following patents are examples of prior art devices: U.S. Pat. No. 6,030,299 to Denny discloses a suspended ball held by a flexible, resilient plate giving resistance to the batter's swing, does offer a training and strengthening device but is mechanically complex and costly to build; U.S. Pat. No. 6,050,908 to Muhlsen discloses a training bat having a handle member with a shock absorbing coupler and at least one detachable elongated contact surface member coupled in the shock absorbing coupler wherein at least one detachable elongated contact surface member has a width significantly less than the width of a regular bat to enhance the eye-to-hand coordination to contact a pitched ball; U.S. Pat. No. 5,595,384 to Hardison, Jr. discloses a bat swing guide including a vertical support member and an arcuate guide attached at one end to the vertical support member. The arcuate guide is generally semi-circular and may be positioned to accommodate either a righthanded or lefthanded hitter. A pivoting tee is attached to the vertical support member for supporting a ball. An adjustable bat stop is attached to the distal end of the arcuate guide; U.S. Pat. No. 5,014,984 to Brockhoff discloses a practice baseball bat having an elongated shaft of predetermined length. One end of the shaft has a hand-grip portion and an elongated, enlarged cylindrical ball contact portion which extends intermediate the ends of the shaft and adjacent the other end of the shaft.

None of the prior art devices provide a training and strengthening device which can be adjusted as to the direction or angle of the swing or by adding additional weights to gradually increase the strength of the body.

SUMMARY OF THE INVENTION

The present invention provides a truncated training bat having a coated steel wire yoke attached to its distal end. A flexible rubber cord (or multiples thereof) is attached by hooked ends to a yoke at one end and to a fixed base at the other. In a further embodiment, the bat is attached by a cord to a pulley and weight resistance system.

It is therefore an object of the invention to provide a new, improved, and inexpensive batting training device that strengthens the batter by using flexible, no impact, resistance.

A further object of the invention is to provide a training device which can be used anywhere there is a suitable attachment or suspension point.

A still further object of the invention is to provide a training device which can be adjusted to give greater or lesser resistance and by so doing, becomes useful to a wide age range of players.

Another object of the invention is to provide a handle dimensioned exactly as a normal baseball bat to familiarize the user with the feel of a regular bat.

These and other objects and advantages of the present invention will be fully apparent from the following description when taken in connection with the annexed drawings.

DESCRIPTION OF A PREFERRED EMBODIMENT

Figure 1:
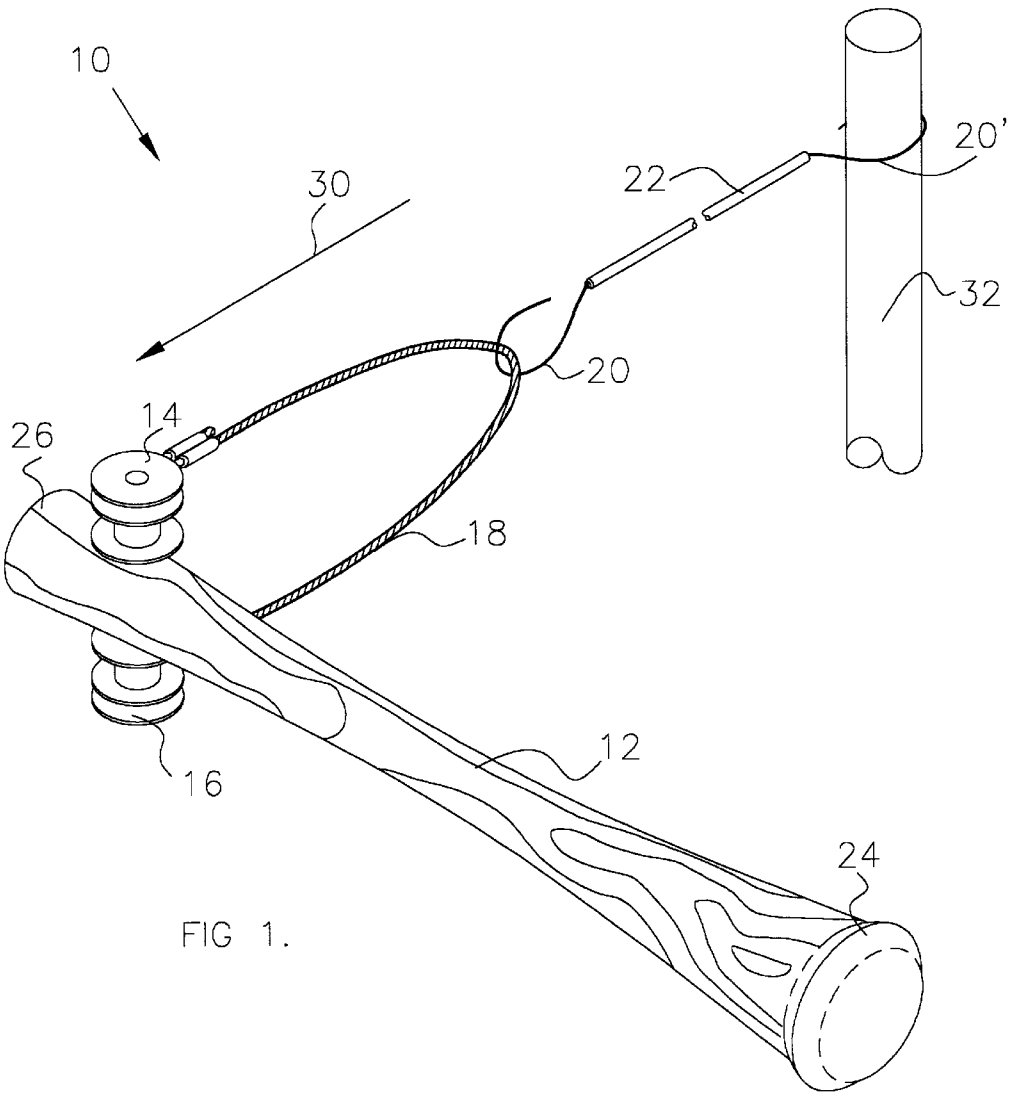
FIG. 1 is an isometric view of a first embodiment of the invention.

The training bat of the invention is light in weight, is small enough to fit in any baseball or softball bag and can be attached and used almost anywhere a person feels like practicing their swing, at a home or on the field. It would be a great asset for any coach, and could be used by everyone from the boys and girls in T-Ball to the players in the pros.

Referring now to the drawings, wherein like numerals refer to like and corresponding parts throughout the several views, in FIGS. 1, 2, 3 and 4, the invention is designated overall by the numeral 10. Bat 12 has a proximal end 24 and a distal end 26. Swivel attachment points 14 and 16 connect yoke 18 to bat 12. The swivel attachment points 14 and 16 are each formed of washers 30 and spacers 31 mounted on shaft 35 to hold the yoke ends 32 in a rotatable position on shaft 33. The assembly of spacers and washers is fixed with a cotter pin 36. In a first embodiment, the Yoke ends 32 were formed in a loop and fastened with fasteners 34.

Hooks 20 and 20', attached at each end of cord 22, connect to fixed anchor 32, providing inertial force against the rotation of bat 12 in the direction of arrow 30.

Figure 2:
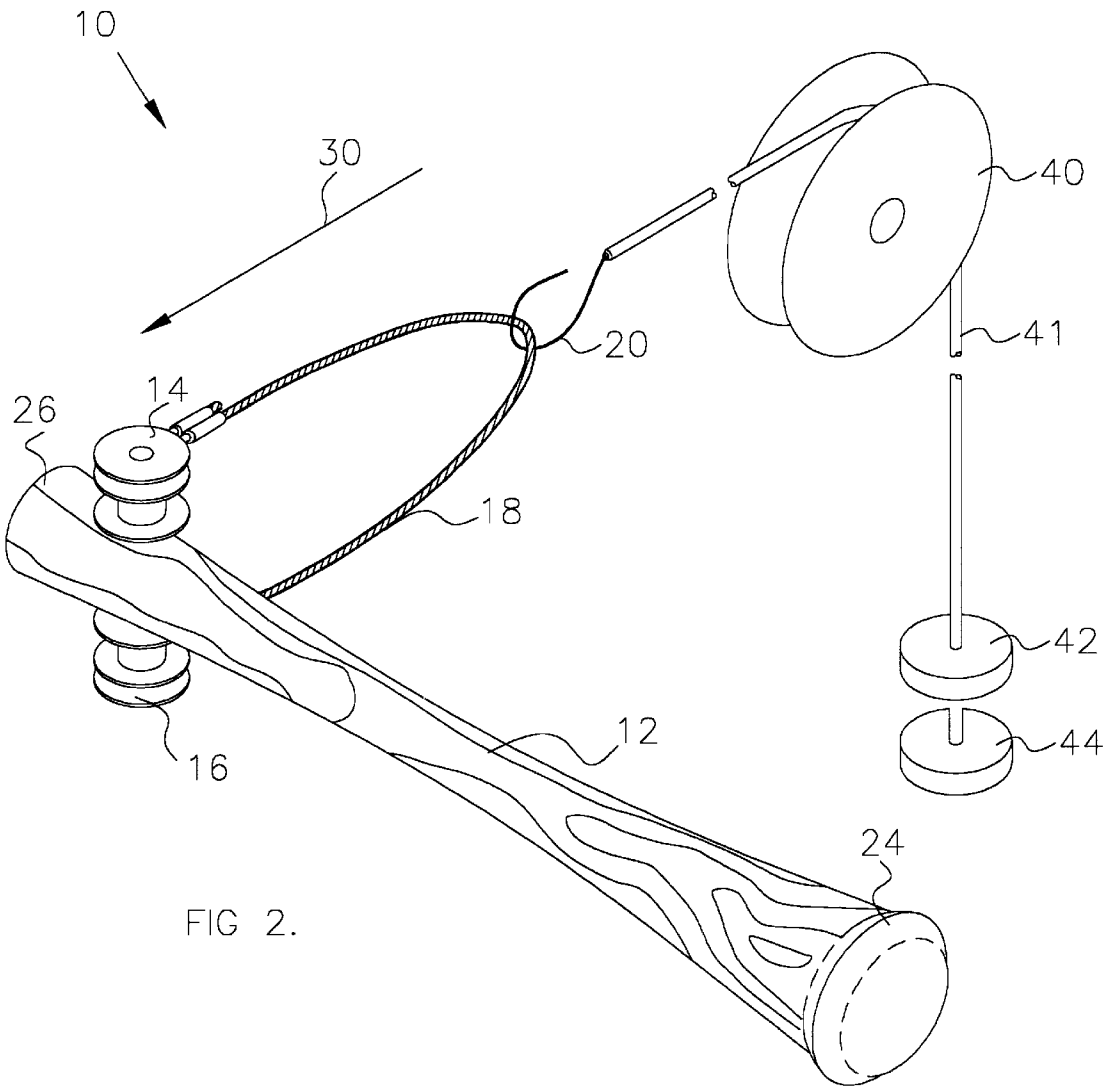
FIG. 2 is an isometric view of a second embodiment of the invention.

Referring to FIG. 2, in an alternative embodiment, base weights 42 and supplemental weight 44 apply tension to cord 41 and inertial force against the rotation of bat 12 in the direction of arrow 30.

Figure 3:
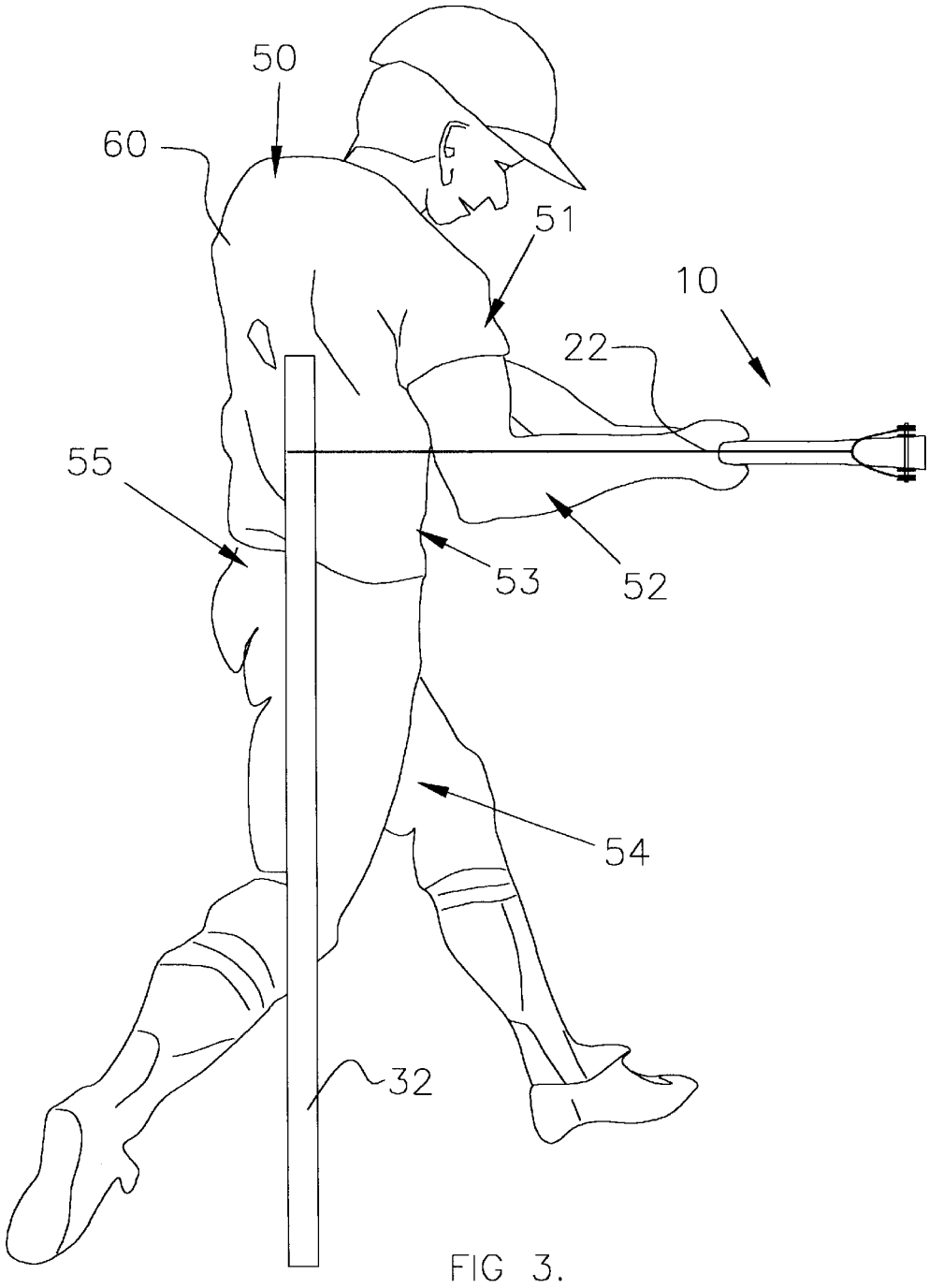
FIG. 3 is an elevational view showing a batter using the training device described herein.
Figure 4:
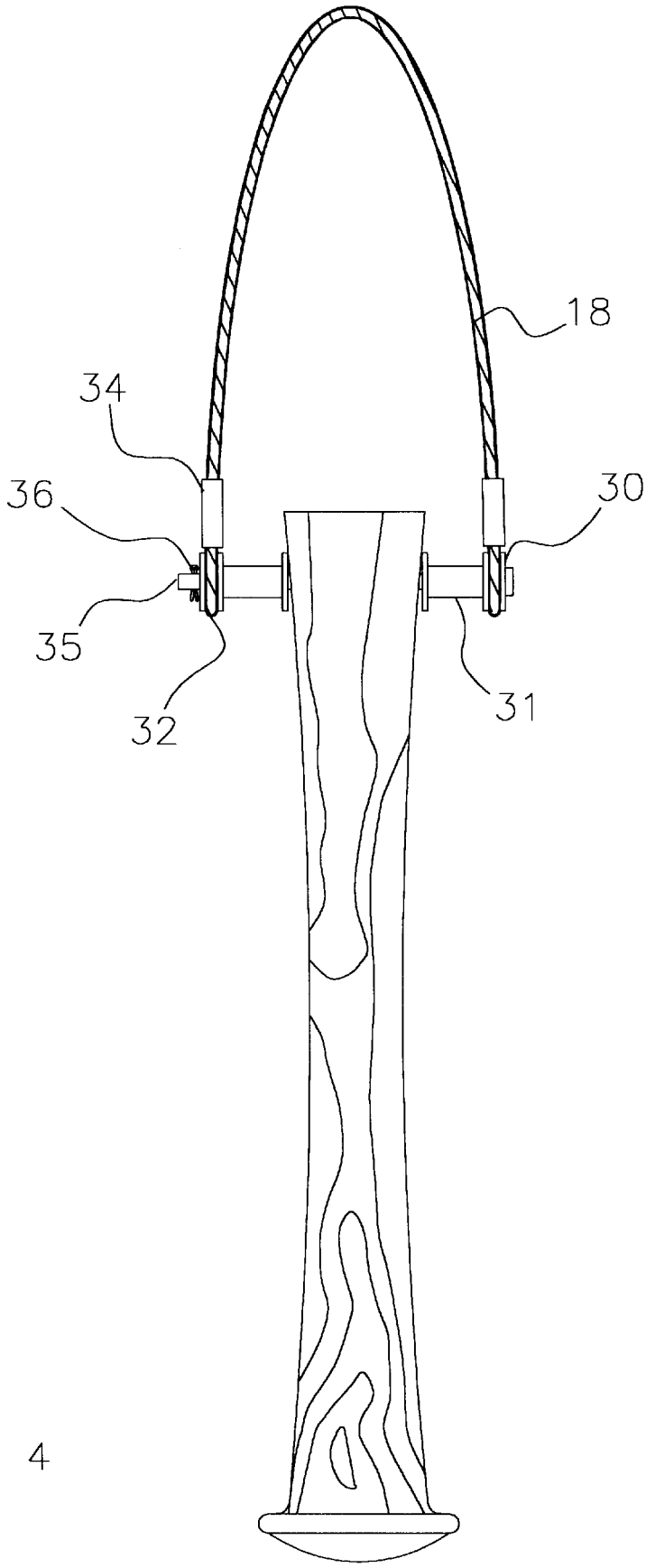
FIG. 4 is a plan view of a yoke assembly in accordance with the invention.

The muscle conditioning effect of the invention in either of its embodiments is seen in FIG. 3. Assuming a normal batting stance, batter 50, gripping the proximal end 24 of the training bat 12, must apply force against the inertial tension in cord 22. Repetitive motions by batter 50 produce both aerobic and/or isometric exercise for muscle groups 60 in the shoulders, in the upper arms 51, in the forearms 52, in the stomach 53, in the thigh leg muscles 54, and in the lower back/gluteus area 55.

The attachment location of cord 22 on anchor pole 32 can be adjusted for each individual batter. By attaching the cord 22 at different heights on a fence, a batter may practice the "swing plain" that he/she prefers. A higher attachment gives a more downward swing plain. When using the power swing invention 10, the batter should swing 10 or more repetitions thereby quickly developing the "quick twitch muscle memory".

The pole 32 is shown as an example of an anchor, however, the most convenient and efficient anchoring point is the batting cage, or fence, where the cord 22 may be attached in an infinite number of locations to perfect a downswing, an upswing, or a horizontal swing as shown in FIG. 3.

What is claimed is:

1. A baseball player training device comprising:

a truncated baseball bat, said bat having a distal end and a proximal end, a shaft having a first end and a second end mounted through said distal end, a pair of swivel attachment points, said attachment points being attached to one of said first and second ends of said shaft at said distal end of said bat, a flexible yoke having two ends, each of said ends being attached in a rotatable position to one of said swivel attachment points, and an elastic cord having a first end and a second end, said elastic cord being rotatably attached to said yoke with a hook at said first end and attached with a hook to an anchor point at said second end, said elastic cord providing resistance to a force applied by the baseball player to said bat, thereby strengthening the muscles used directly in hitting a baseball.

2. A baseball player training device of claim 1 wherein said swivel attachment points comprise an assembly of washers and spacers mounted on opposite ends of said shaft attached to said distal end and a yoke end formed in a loop and rotatably mounted on said swivel attachment points.

* * * * *